US005410862A

United States Patent [19]

Janhonen

[11] Patent Number: 5,410,862

[45] Date of Patent: May 2, 1995

[54] PACKAGING MACHINE FOR WRAPPING BOOKS OR THE LIKE

[75] Inventor: Veikko Janhonen, Helsinki, Finland

[73] Assignee: Pussikeskus Oy, Helsinki, Finland

[21] Appl. No.: 253,957

[22] Filed: Jun. 3, 1994

[30] Foreign Application Priority Data

Jun. 14, 1993 [FI] Finland ..... 932730

[51] Int. Cl.[6] ..... B65B 11/00; B65B 13/14

[52] U.S. Cl. ..... 53/590; 53/218; 53/209; 53/215; 53/466

[58] Field of Search ..... 53/218, 228, 209, 462, 53/466, 215, 586, 590

[56] References Cited

U.S. PATENT DOCUMENTS

| | | | |
|---|---|---|---|
| 4,570,422 | 2/1986 | Watanabe et al. | 53/590 |
| 4,627,223 | 12/1986 | Janhonen | 53/449 |
| 4,930,293 | 6/1990 | Hanscom | 53/590 |
| 4,956,961 | 9/1990 | Janhonen | 53/176 |
| 4,972,653 | 11/1990 | Janhonen | 53/504 |
| 5,115,618 | 5/1992 | Janhonen | 53/449 |
| 5,248,034 | 9/1993 | Janhonen | 206/424 |

FOREIGN PATENT DOCUMENTS

| | | |
|---|---|---|
| 273240 | 10/1990 | European Pat. Off. . |
| 378787 | 9/1992 | European Pat. Off. . |

*Primary Examiner*—Lowell A. Larson
*Assistant Examiner*—Rodney A. Butler
*Attorney, Agent, or Firm*—Price, Heneveld, Cooper, DeWitt & Litton

[57] ABSTRACT

The invention relates to a packaging machine for wrapping books or the like for postal deliveries. The package blank includes a rectangularly shaped outer cardboard (2), which is folded by means of transverse belts (5) from a flat condition to a tube surrounding the four sides of a book. The belts (5) extend through sliding slots included in the bottom edge of guides (8) and said guides (8) are operated in vertical and horizontal plane by means of pneumatic cylinders (11, 14). The apparatus also requires two sets of individually operable press plates (6 and 7) for pressing the package from above before and after the folding of a sheet of cardboard (2). (FIG. 2)

13 Claims, 4 Drawing Sheets

PACKAGING MACHINE FOR WRAPPING BOOKS OR THE LIKE

The present invention relates to a packaging machine for wrapping books or the like for postal deliveries by using a package blank, including a rectangularly shaped outer cardboard, said machine comprising a conveyor track, an adhesive application station alongside the conveyor track upstream of a wrapping station, a wrapping station which includes folding elements on either side of the conveyor track for folding said outer cardboard from a flat condition to a tube surrounding the four sides of a book, and a press element operable in vertical direction above the conveyor track for pressing the overlapped ends of the outer cardboard against the top surface of a book in view of fastening the ends to each other by means of an adhesive applied therebetween.

This type of packaging machine is prior known from the Applicant's Patent publications EP-0,273,240 and EP-0,378,787. These prior known devices are very useful but their construction is quite complicated and the price is high. The former has a little less complicated construction but it is respectively slower in operation.

An object of the invention is to provide an improved packaging machine which has a simple construction and is inexpensive in relation to production capacity.

A further object of the invention is to provide an improved packaging machine for wrapping books of varying sizes, a plurality of books or piles of documents.

These objects are achieved by means of a packaging machine of the invention, which is characterized in that the wrapping station is further provided with second press elements, including a horizontal press plate which has one unsupported end and is operable both in vertical direction and in the direction of the conveyor track by means of individually controlled power units, and that said folding elements include transverse belts which extend through sliding slots included in the bottom edge of guides, said guides being adapted to be operable in vertical and horizontal plane by means of power units, whose automatic control moves the guides first upwards, then towards each other, and then alternately downwards in such a manner that the belts are first elevated from the conveyor track level as said second press elements press the top side of the package blank, whereby said belts fold the end sections of the outer cardboard first upwards and then alternately on top of each other in an overlapping fashion while said second press elements travel in the direction of the conveyor track for retracting said press plate from underneath the folded end sections of the outer cardboard.

Thus, the transverse belts perform the entire outer cardboard folding operation and there is no need for elevating and lowering the track level.

In view of eliminating the need of the preliminary centering of a package on the conveyor track, yet effecting the folding of both sides with a suitable tension without excessive pressing, in a preferred embodiment of the invention, the wrapping station includes sensor elements, which travel along with the guides and collide with the sides of a package blank as the end sections of the outer cardboard are upright in a position inclined towards each other, one of said guides stopping or decelerating its motion with the other guide effecting a stroke downwards. However, it is possible to replace the sensor elements with means for centering a package blank on the track, as disclosed e.g. in Patent publication EP-0,378,787.

The invention will now be described in more detail with reference made to the accompanying drawings, in which FIG. 1 shows schematically a packaging machine of the invention without depicting all of the components included in a wrapping station;

Figure 1:
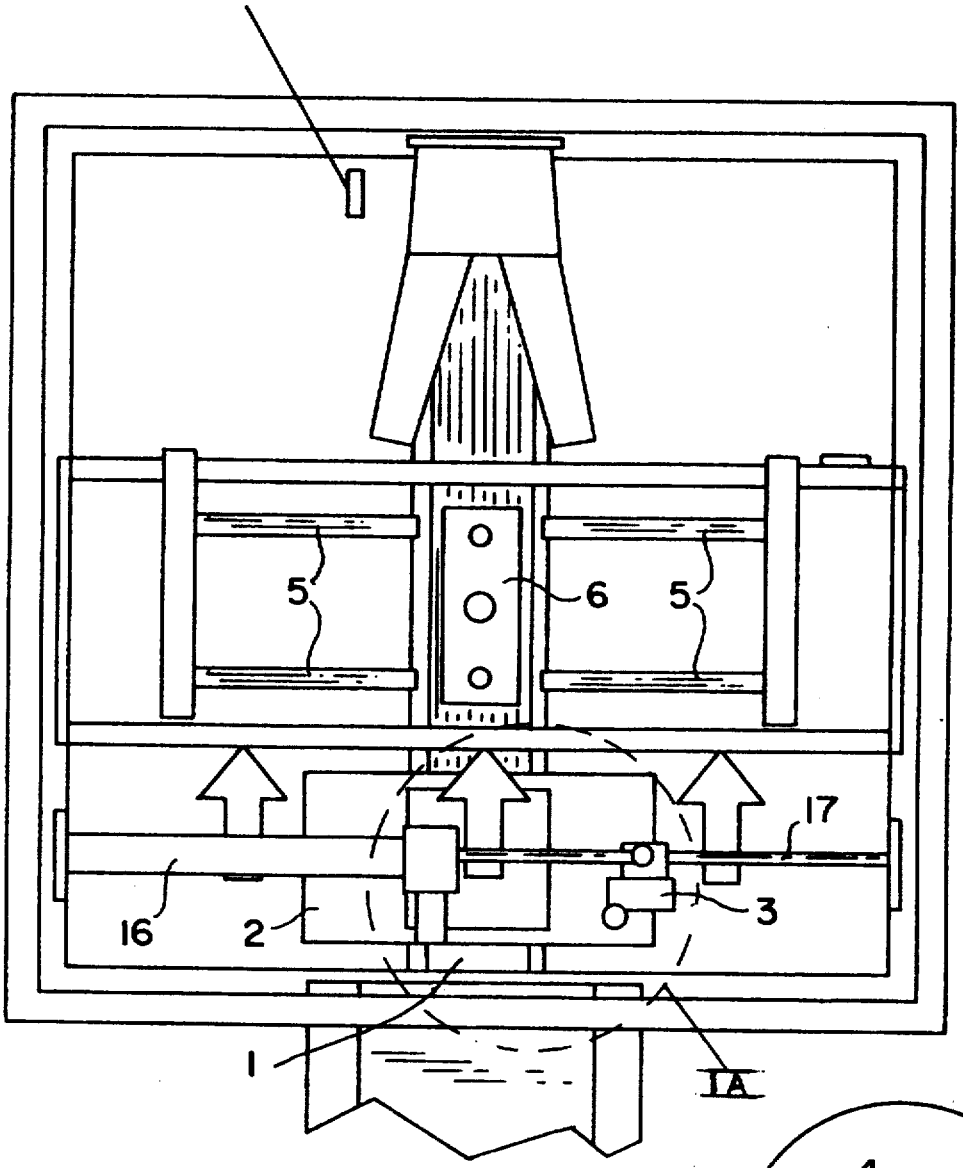
FIG. 1A is a perspective view of the area of the packaging machine of the invention outlined in area IA of FIG. 1.
Figure 1A:
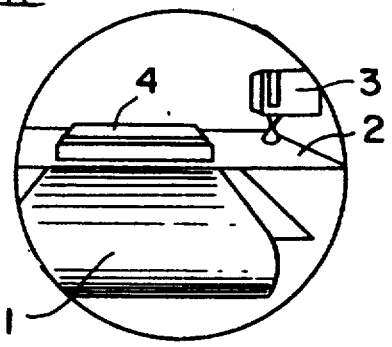
Figure 2:
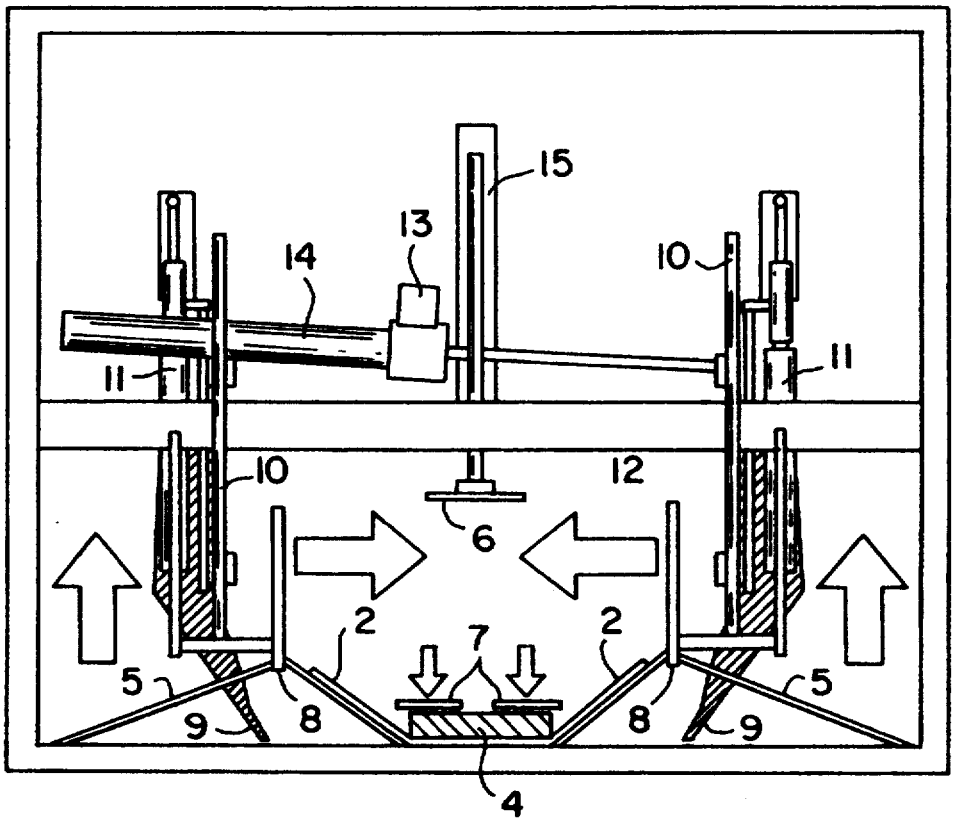
FIG. 2 shows the same machine viewed in the track direction at the initial stage of wrapping with all essential components of a wrapping station depicted.

In reference to FIGS. 1 and 2, the overall machine construction will now be described. A package blank 2, 4 is carried on a conveyor track 1 into a wrapping station. A typical package blank is such that one or more books or a pile of documents are enclosed in an inner wrapper 4 of paper surrounding the four sides of a book. This preliminary wrapping operation can be performed manually, since the flexible inner wrapper is easy to handle. On the other hand, the folding of a rather stiff outer cardboard 2 is effected according to the invention with a machine as performing this operation manually would cause stress injuries in the wrists.

Alongside the track 1 upstream of a wrapping station lies a hot-setting adhesive application station, including a sizing orifice 3 which is located above the outer cardboard 2 near one of its lateral edges. The location of package blanks manually loaded on the conveyor in the cross-track direction may vary and the same applies to the length of a sheet of cardboard 2 in the cross-track direction. Thus, the location of the sizing orifice 3 must be set separately for each package. Therefore, the sizing orifice 3 is mounted on cross guides 17, along which it is operable by means of a pneumatic cylinder 16. An electric eye included in the orifice 3 detects the outer edge of cardboard 2 and stops the sizing orifice always at a certain distance therefrom. In the case of long series driven with the same package blank, whose sufficient centering is taken care of, the orifice 3 may remain stationary until it is shifted to a new position as the package blank is replaced with a new one.

The wrapping station includes transverse belts 5, which extend below track 1 or are fastened by the ends thereof alongside the edges of track 1. The track 1 must have a width which is less than that of a finished package for extending the free section of said belts 5 at least to some extent below the edges of a book to be wrapped. On either side of the track there are two parallel belts 5, the floor plate of a wrapping station being provided with slots or recesses therefor in such a manner that the belts will be able to descend to the floor level of a wrapping station in view of preventing the leading edge of a package blank from colliding with the belts upon arriving in the wrapping station on top of the belts. The outer ends of belts 5 can be twined around spring-loaded cylinders (not shown) or joined as a loop which is maintained in permanent tension by means of spring-loaded reversing rollers (not shown). What is essential is that the belts 5 can be pulled to a more or less full view from the track level while still keeping the belts 5 tight.

On either side of the track 1 there is a pair of guides consisting of two guides 8. Each pair of guides 8 is mounted on a frame tube or girder 12 to be operable by means of vertical guideways 10 and horizontal guideways as a single unit in vertical and horizontal direction. Each pair of guides 8 is provided with sensor elements 9, which are movable therewith and whose operation will be described hereinafter. The bottom edge of each guide 8 is provided with a slot for passing the belt 5 therethrough in a sliding fashion. Naturally, the element limiting the slot and supporting the belt 5 may be a thin cylinder or needle bearing with no actual sliding occurring between belt 5 and guide 8. What is essential is that, in its longitudinal direction, the belt 5 is capable of passing through a slot included in the guide 8.

Each pair of guides 8 is adapted to be operable in vertical direction by means of pneumatic cylinders 11 and in horizontal direction by means of pneumatic cylinders 14, whose cylinder end closer to the piston rod is fastened to a body 13. In horizontal direction, said guides 8 are movable symmetrically towards or away from each other. In vertical direction, on the other hand, said guides 8 can be movable non-simultaneously, since the pairs of guides 8 mounted on the opposite sides of the track are provided with their own cylinders 11 for vertical action.

Figure 3:
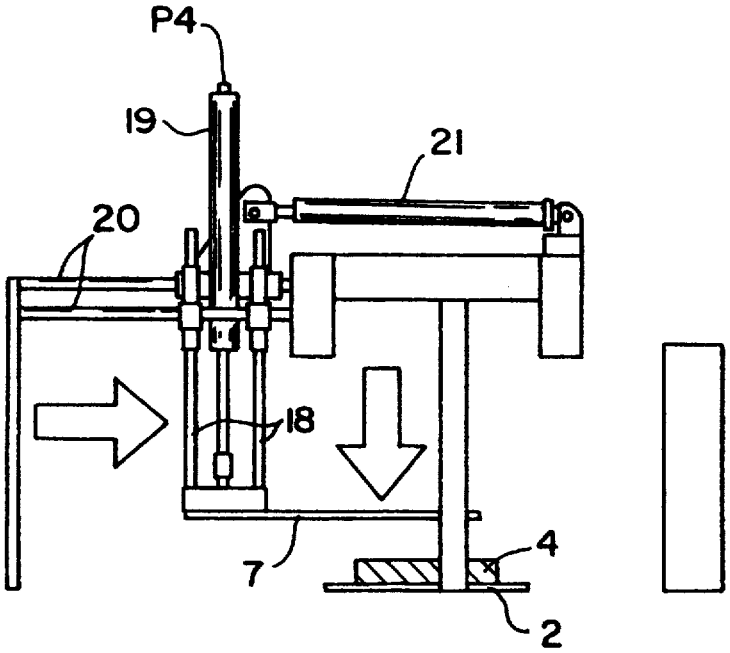
FIG. 3 is a side view of press elements used during a package folding operation for holding a package blank in contact with the track.

In the middle of a wrapping station above the track lies a press plate 6, movable in vertical direction by means of a pneumatic cylinder 15. Upstream of the press plate 6 lies a second press element, including two parallel, horizontal or flat plates 7 which are unsupported by one end thereof, as shown in FIG. 3. The press plates 7 are fastened by the other end thereof to the bottom end of vertical guideways 18 and the vertical guideways are in turn braced to horizontal guideways 20. Thus, the press plates 7 can be operated by means of pneumatic cylinders 19 and 21 in vertical and horizontal direction.

Figure 4:
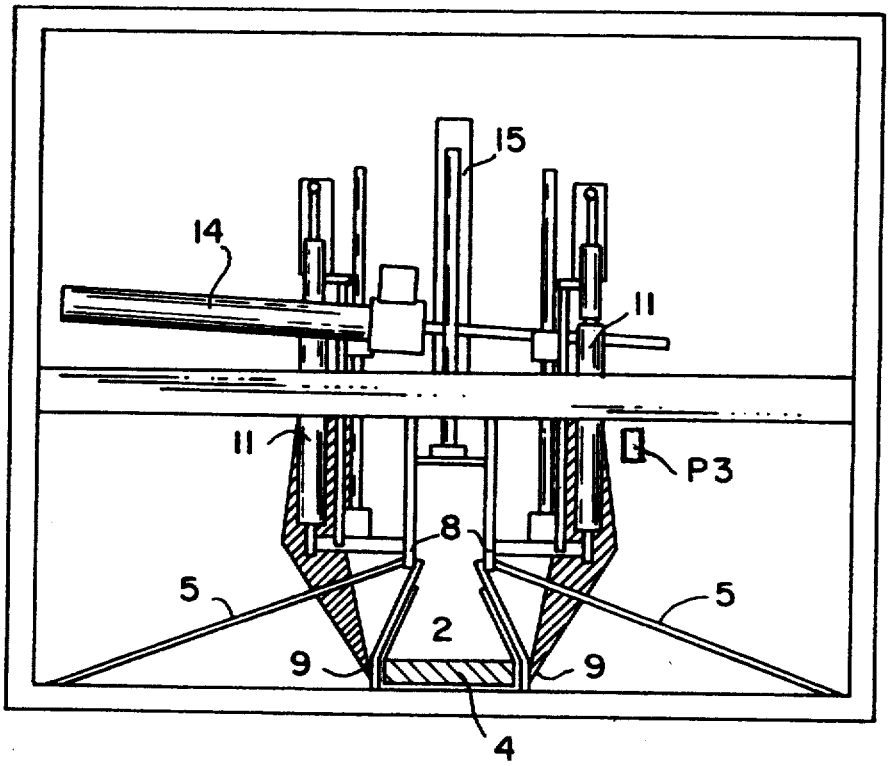
FIGS. 4–7 illustrate the same as FIG. 2 but in each figure the mechanical components have advanced to the next wrapping operation.

The apparatus operates as follows. After driving a package blank fo a position on top of the belts 5, the lifting of belts 5 is initiated by cylinders 11, as shown in FIG. 2. Prior to initiating the lifting, the press plates 7 are pressed against the top side of a blank 4 for maintaining the blank in contact with the track during the folding of cardboard 2. During the final stage of lifting the belts 5, the cylinder 14 is operated for pulling the guides 8 towards each other reaching the condition shown in FIG. 4, wherein the ends of the sheet of cardboard 2 are directed obliquely upwards in a position inclined towards each other. At this time the sensor elements 9 come into contact with the sides of the package blank. The sensor elements 9 can be slightly yielding for increasing the leaning pressure as the guides 8 approach each other. As the leaning pressure of sensor elements 9 becomes sufficiently high, e.g. in the position shown in FIG. 4, said sensor elements 9 deliver a control message to the valve of cylinder 14, which stops the movement of guides 8 towards each other.

Figure 5:
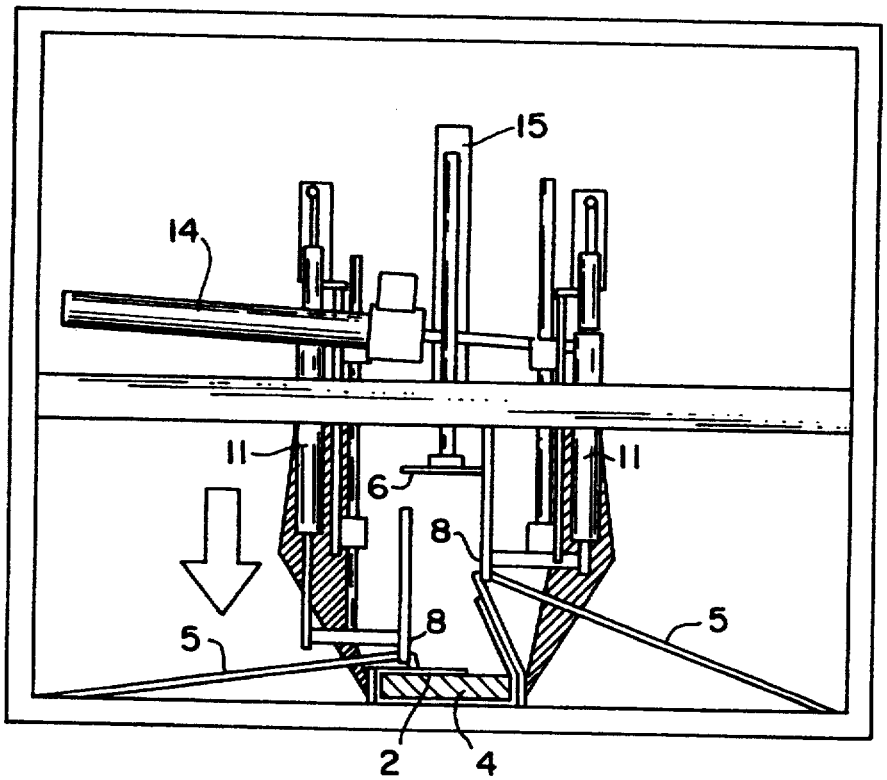

FIG. 5 illustrates the following stage, wherein the cylinder 11 on the left, i.e. located on the side of the track opposite to the orifice 3, presses down the corresponding pair of guides 8 for folding one end of the sheet of cardboard 2 against the top side of the package blank. At the same time, the press plates 7 are retracted from underneath the foldable end sections of outer cardboard 2 with a movement parallel to the track 1 along guideways 20 (FIG. 3) by using the power of a cylinder 21.

Figure 6:
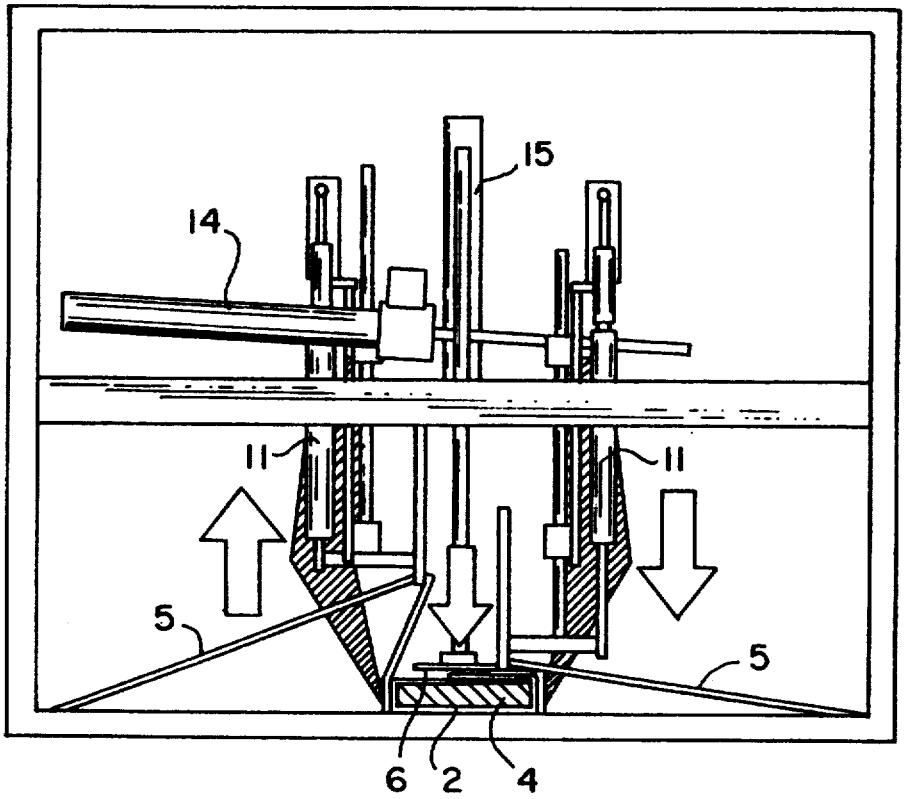

In FIG. 6, the operation has progressed to a stage, wherein the left-hand cylinder 11 effects a lifting action and the right-hand cylinder 11 lowers down the respective guide 8 and its accompanying belt 5 for folding down also the other, adhesive-carrying end section of cardboard 2 and overlapping it on top of the first end section. A cylinder 15 presses down the press plate 6. The press plate 6 compresses the end sections of the sheet of cardboard 2 against each other along the entire length of the sizing joint with a sufficient force and duration for fastening the end sections of the sheet of cardboard 2 to each other. A hot-setting adhesive becomes sufficiently adherent in just a few seconds after its injection for preventing the package from opening by itself until the final setting is achieved.

Figure 7:
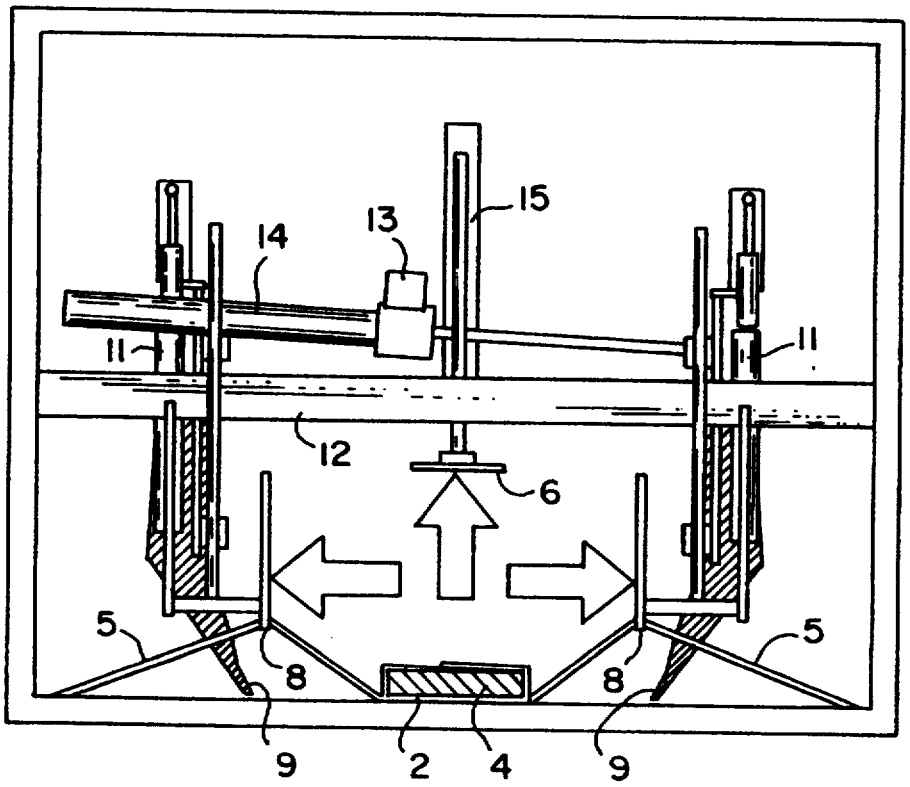

FIG. 7 illustrates a condition, wherein the guides 8 and the press plate 6 are withdrawn from a finished package and from each other. The press plate 6 is not removed from the top side of the package until the belts 5 are lowered by means of guides 8 down to the track level or at least close to it. Thus, FIG. 7 illustrates the situation with the belts 5 still substantially elevated, whereby the press plate 6 could still lie against the top side of a package. Finally, the conveyor belt 1, which has been stationary, can be actuated for removing a finished package from the wrapping station and for bringing a fresh package blank in.

I claim:

1. A packaging machine for wrapping books or the like for postal deliveries by using a package blank (2, 4), including a rectangularly shaped outer cardboard (2), said machine comprising a conveyor track (1), an adhesive application station (3) alongside the conveyor track upstream of a wrapping station, a wrapping station which includes folding elements (5, 8) on either side of the conveyor track for folding said outer cardboard from a flat condition to a tube surrounding the four sides of a book, and a press element (6) operable in vertical direction above the conveyor track for pressing the overlapped ends of the outer cardboard against the top surface of a book in view of fastening the ends to each other by means of an adhesive applied therebetween, characterized in that the wrapping station is further provided with second press elements (7, 18–21), including a horizontal press plate (7) which has one unsupported end and is operable both in vertical direction and in the direction of the conveyor track by means of individually controlled power units (19, 21), and that said folding elements include transverse belts (5) which extend through sliding slots included in the bottom edge of guides (8), said guides (8) being adapted to be operable in vertical and horizontal plane by means of power units (11, 14), whose automatic control moves the guides (8) first upwards, then towards each other, and then alternately downwards in such a manner that the belts are first elevated from the level of the conveyor track (1) as said second press elements (7) press the top side of the package blank, whereby said belts fold the end sections of the outer cardboard (2) first upwards and then alternately on top of each other in an overlapping fashion while said second press elements (7) travel in the direction of the conveyor track for retracting said press plate from underneath the folded end sections of the outer cardboard.

2. An apparatus as set forth in claim 1, characterized in that the wrapping station includes sensor elements (9), which travel along with the guides (8) and collide with the sides of a package blank as the end sections of the outer cardboard are upright in a position inclined towards each other, one of said guides (8) stopping or decelerating its motion with the other guide (8) effecting a stroke downwards.

3. A packaging machine for wrapping an object having opposite sides using a generally rectangular cardboard piece comprising:

a conveyor extending in a predetermined direction and having a wrapping station including at least one pair of elongated belts extending transverse to said conveyor, one belt on either side of said conveyor, a pair of guides, one guide on each side of said conveyor, each guide having an opening supporting one of said belts for sliding movement therethrough, a first press element movable in a vertical direction toward and away from said conveyor, and a second press element movable in said vertical direction and in the direction of said conveyor;

a control;

said guides each having a power unit adapted to move said guide in response to said control first upwards, then towards one another, then alternately downwards such that said belts are first elevated from the level of said conveyor while said second press element engages the top of the object to hold the object and cardboard against said conveyor, whereby said belts fold end sections of the cardboard which project transversely of said conveyor first upwards and then alternately on top of one another in overlapping fashion while said second press element is moved in said direction of said conveyor for withdrawal from underneath the folded cardboard end sections and said first press element is pressed against the overlapped end sections of the cardboard to form a tube surrounding the object.

4. The packaging machine of claim 3 including an adhesive application station upstream of said wrapping station and having an adhesive applicator unit adjacent said conveyor for applying an adhesive to at least one of the cardboard end sections prior to operation of said guides for folding said end sections.

5. The packaging machine of claim 3 wherein said wrapping station also includes a pair of sensors connected to said control, one sensor associated with each of said guides and movable with such guide, said sensors engaging the sides of the object as said guides are moved toward one another when the cardboard end sections are upright in a position inclined toward one another causing movement of said guides to stop and allowing the cardboard end sections to be alternately folded down on top of one another.

6. The packaging machine of claim 3 including separate power units for moving each of said first and second press elements.

7. The packaging machine of claim 3 including two pair of elongated belts at said wrapping station, two of said belts being spaced in said direction of said conveyor on each side of said conveyor, each of said belts supported by at least one guide.

8. A packaging machine for wrapping an object having opposite sides using a generally rectangular cardboard piece comprising:

a conveyor extending in a predetermined direction and having a wrapping station;

at least one pair of elongated belts extending transverse to said conveyor, one belt on either side of said conveyor at said wrapping station;

a first press element;

a control;

guide means for moving segments of said belts in response to said control first upwards, then toward one another, then alternately downwards such that said belts are elevated from the level of said conveyor to fold end sections of the cardboard which project transversely of said conveyor first upwards and then alternately on top of one another in overlapping fashion to form a tube surrounding the object;

first power means for engaging said first press element with the top of the object to hold the object and cardboard against said conveyor during folding of the cardboard end sections and for withdrawing said first press element from beneath the folded cardboard end sections.

9. The packaging machine of claim 8 including a second press element and second power means for moving said second press element toward and away from the object to press the overlapped end sections of the cardboard against one another and the object.

10. The packaging machine of claim 9 including an adhesive application station upstream of said wrapping station and having an adhesive applicator unit adjacent said conveyor for applying an adhesive to at least one of the cardboard end sections prior to operation of said guide means for folding the cardboard end sections.

11. The packaging machine of claim 10 wherein said wrapping station also includes a pair of sensors connected to said control, said guide means including a pair of guides, one guide on either side of said conveyor, each guide having an opening supporting one of said belts for sliding movement therethrough, one sensor associated with each of said guides and movable with such guide, said sensors engaging the sides of the object as said guides are moved toward one another when the cardboard end sections are upright in a position inclined toward one another whereby movement of said guides is stopped and the cardboard end sections are allowed to be alternately folded down on top of one another.

12. The packaging machine of claim 11 including two pair of elongated belts at said wrapping station, two belts being spaced in said direction of said conveyor on each side of said conveyor, each of said belts supported by at least one guide.

13. The packaging machine of claim 8 wherein said first press element is a horizontal press plate having one unsupported end for engaging the top of the object; said first power means including means for moving said horizontal press plate in both a vertical direction and said direction of said conveyor.

* * * * *